US008275289B2

(12) United States Patent
Noso

(10) Patent No.: US 8,275,289 B2
(45) Date of Patent: Sep. 25, 2012

(54) FIXING UNIT AND IMAGE FORMING APPARATUS THEREWITH

(75) Inventor: Terumitsu Noso, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 290 days.

(21) Appl. No.: 12/714,839

(22) Filed: Mar. 1, 2010

(65) Prior Publication Data

US 2010/0239316 A1 Sep. 23, 2010

(30) Foreign Application Priority Data

Mar. 17, 2009 (JP) ..... 2009-064028

(51) Int. Cl.
*G03G 15/16* (2006.01)
*G03G 15/20* (2006.01)

(52) U.S. Cl. ..... 399/122; 399/320; 399/328; 399/330

(58) Field of Classification Search ..... 399/122, 399/320, 328, 329, 330, 334; 347/156
See application file for complete search history.

(56) References Cited

U.S. PATENT DOCUMENTS 6,442,360 B1 * 8/2002 Onodera et al. ..... 399/122
7,113,722 B2 * 9/2006 Chung et al. ..... 399/122 X
7,386,265 B2 * 6/2008 Ito et al. ..... 399/330
7,406,286 B2 * 7/2008 Yoshioka et al. ..... 399/328

FOREIGN PATENT DOCUMENTS

JP 2002-296938 10/2002

* cited by examiner

*Primary Examiner* — Sandra Brase
(74) *Attorney, Agent, or Firm* — Smith, Gambrell & Russell, LLP

(57) ABSTRACT

A fixing unit is provided with a heat roller having a plurality of heaters provided therein for applying heat to a toner image formed on a sheet of paper, an upper-side casing for holding the heat roller, a holding member detachably fitted to the upper-side casing, and a plurality of fitting portions that are provided in the holding member and to which first to third terminal portions of the plurality of heaters can be detachably fitted from a same direction.

13 Claims, 7 Drawing Sheets

FIXING UNIT AND IMAGE FORMING APPARATUS THEREWITH

This application is based on Japanese Patent Application No. 2009-064028 filed on Mar. 17, 2009, the contents of which are hereby incorporated by reference.

BACKGROUND OF THE INVENTION

1. Field of the Invention

The present invention relates to a fixing unit for use in image forming apparatuses employing an electro-photographic method such as copiers, printers, facsimile machines, and multifunction peripherals having these functions, and in particular, relates to a fixing unit having a plurality of heaters provided in a heat roller and an image forming apparatus provided therewith.

2. Description of Related Art

Image forming apparatuses such as electro-photographic copiers and printers have conventionally been provided with a fixing unit that fixes a toner image on a sheet of paper when a sheet having a non-fixed toner image formed thereon passes through a nip portion at which a heat roller and a pressure roller are pressed against each other. Inside the heat roller, a heater is provided for heating the roller, and in particular, a plurality of heaters are provided in the heat roller of a medium-speed or high-speed image forming apparatus. It has been proposed to integrally form the terminals of a plurality of heaters for the purpose of improving workability in inserting the plurality of heaters into a heat roller and fitting the heaters to the casing of a unit.

In an example, a terminal portion is provided at each end of two heaters provided in a heat roller, and a hole portion is formed in each of the terminal portions. The terminal portions are integrally connected together by a conductive connection member. The connection member is formed in a U-shape. With the terminal portion of one of the heaters in contact with one side-surface portion of the U-shaped connection member, a screw is inserted and screwed into the hole portion formed in the terminal portion and a hole portion formed in the side-surface portion of the connection member. Likewise, with the terminal portion of the other heater in contact with the other side-surface portion of the U-shaped connection member, a screw is inserted and screwed into the hole portion formed in the terminal portion and a hole portion formed in the other side-surface of the connection member. Thereby, the terminal portions of the heaters are fitted to the connection member. The two heaters are inserted into the heat roller from the side of the terminal portions fitted to the connection member.

Since the terminal portions of the two heaters are integrally connected together by the connection member, the heaters can be inserted into the heat roller and the two heaters can be fitted to the casing of the fixing unit with improved workability. Furthermore, if heater failure occurs, the connection member can be pulled out of the unit casing and only the broken one of the two heaters can be replaced.

However, in this example, in fitting the plurality of heaters to the connection member, since the connection member is formed in a U-shape, the screws are inserted and screwed into the holes from opposite directions with the terminal portions fitted to the side-surface portions of the connection member that face opposite directions. This inconveniently impairs the fitting workability.

SUMMARY OF THE INVENTION

The present invention has been made to solve the above problems, and an object of the present invention is to provide a fixing unit capable of facilitating fitting of a plurality of heaters and insertion of the plurality of heaters into a heat roller, and an image forming apparatus provided with such a fixing unit.

To achieve the above object, according to one aspect of the present invention, a fixing unit is provided with a heat roller having a plurality of heaters provided therein, a casing holding the heat roller, a holding member detachably fitted to the casing, and a plurality of fitting portions that are provided in the holding member and to which terminal portions of the plurality of heaters can be detachably fitted from a same direction.

With this structure, the terminal portions of the plurality of heaters can each be fitted to a corresponding one of the fitting portions from the same direction, and this helps improve the workability in fitting the plurality of heaters to the holding member. Furthermore, by inserting the plurality of heaters fitted to the holding member into the heat roller all together, the workability in inserting the heaters into the heat roller can be improved. Moreover, the plurality of heaters can be taken out of the heat roller with improved workability.

According to the present invention, in the fixing unit structured as described above, it is preferable that the plurality of fitting portions be arranged at positions different from one another in an axial direction of the heat roller.

With this structure, for example, the terminal portions of the heaters having different heat distribution characteristics can each be fitted to a predetermined fitting portion, and this helps prevent the heaters from being fitted in wrong positions in the holding member. Furthermore, inserting the plurality of heaters into the heat roller after they are fitted in the predetermined positions in the holding member eliminates the trouble of adjusting the positions of the heaters having different heat distribution characteristics inside the heat roller, leading to improved workability.

According to the present invention, in the fixing unit structured as described above, it is preferable that lengths of the plurality of heaters in the axial direction of the heat roller be different from one another, and that, when the terminal portions of the plurality of heaters are fitted to the fitting portions, when the terminal portions of the plurality of heaters are fitted to the fitting portions, positions of ends of the plurality of heaters at a side that is, in the axial direction of the heat roller, opposite from a side where the holding member is located are equal to one another in the axial direction of the heat roller.

With this structure, if the positions of the ends of the plurality of heaters at the side that is, in the axial direction of the heat roller, opposite from the side where the holding member is located are not equal to one another in the axial direction of the heat roller, it means that the plurality of heaters are not fitted to the predetermined positions. Thus, erroneous fitting of the heaters can be easily found.

According to the present invention, in the fixing unit structured as described above, it is preferable that a mark portion be provided in a vicinity of the fitting portions for recognition of which of the terminal portions is to be fitted to which of the fitting portions.

With this structure, in fitting the terminal portions of the plurality of heaters to the holding member, the fitting portions corresponding to the heaters are recognized by the mark portion, and this helps prevent the heaters from being fitted in wrong positions.

According to the present invention, in the fixing unit structured as described above, it is preferable that, as the mark portion, a mark be formed corresponding to a color of an insulation tube covering a lead wire among lead wires fitted to the terminal portions.

With this structure, by matching the color of the insulation tube to the mark corresponding to the color in fitting the terminal portions of the heaters to the holding member, it is possible to prevent the heaters from being fitted in wrong positions.

According to the present invention, in the fixing unit structured as described above, it is preferable that the plurality of fitting portions have flat portions with which the plurality of terminal portions are brought into contact to face a same direction.

With this structure, since the terminal portions of the heaters are brought into contact with and fitted to the plurality of flat portions that face a same direction, the plurality of heaters can be fitted to the holding member with improved workability.

According to the present invention, in the fixing unit structured as described above, it is preferable that the plurality of fitting portions have positioning portions determining fitting positions of the plurality of terminal portions in the holding member.

With this structure, the terminal portions can be fitted by setting them to the positioning portions of the holding member, and this eliminates the trouble of positioning.

According to the present invention, in the fixing unit structured as described above, it is preferable that the terminal portions and the flat portions be fitted together with screws and nuts into which the screws are screwed.

With this structure, the terminal portions of the heaters can be maintained securely fixed to the flat portions with the screws and nuts.

According to the present invention, in the fixing unit structured as described above, it is preferable that the nuts be plate-shaped, and that the plurality of fitting portions have hollow portions that accommodate the nuts.

With this structure, the terminal portions are fitted to the fitting portions by screwing the screws into the nuts accommodated in the hollow portions of the fitting portions, and at this time, the nuts do not rotate. This eliminates the trouble of holding the nuts while the screws are being screwed into the nuts, leading to improved workability in fitting the terminal portions of the heaters to the holding member.

According to the present invention, in the fixing unit structured as described above, it is preferable that a pressure roller be provided to be pressed against the heat roller, and that, at a nip portion at which the heat roller and the pressure roller are pressed against each other, a toner image formed on paper be fixed by being heated.

With this structure, the toner image formed on the paper can be fixed by heating at the nip portion. Furthermore, since the terminal portions of the plurality of heaters can be detachably fitted to the holding member from the same direction, the plurality of heaters can be fitted to the holding member with improved workability. Moreover, by inserting the plurality of heaters fitted to the holding member into the heat roller all together, the heaters can be inserted into the heat roller with improved workability.

According to the present invention, in the fixing unit structured as described above, it is preferable that a fixing belt formed as an endless belt be wound around the heat roller and a fixing roller, that a pressure roller be provided to be pressed against the fixing roller with the fixing belt therebetween, and that a toner image formed on paper be fixed by being heated at a nip portion at which the fixing belt and the pressure roller are pressed against each other.

With this structure, the toner image on the paper can be fixed by heating at the nip portion. Furthermore, since the terminal portions of the plurality of heaters can be detachably fitted to the holding member from the same direction, the plurality of heaters can be fitted to the holding member with improved workability. Moreover, by inserting the plurality of heaters fitted to the holding member into the heat roller all together, the heaters can be inserted into the heat roller with improved workability.

DETAILED DESCRIPTION OF PREFERRED EMBODIMENTS

Hereinafter, embodiments of the present invention will be described with reference to the attached drawings, but it should be understood that the present invention is not limited to these embodiments. Also, the application of the present invention described herein and terms used in the description should not be construed in a limited manner.

First Embodiment

Figure 1:
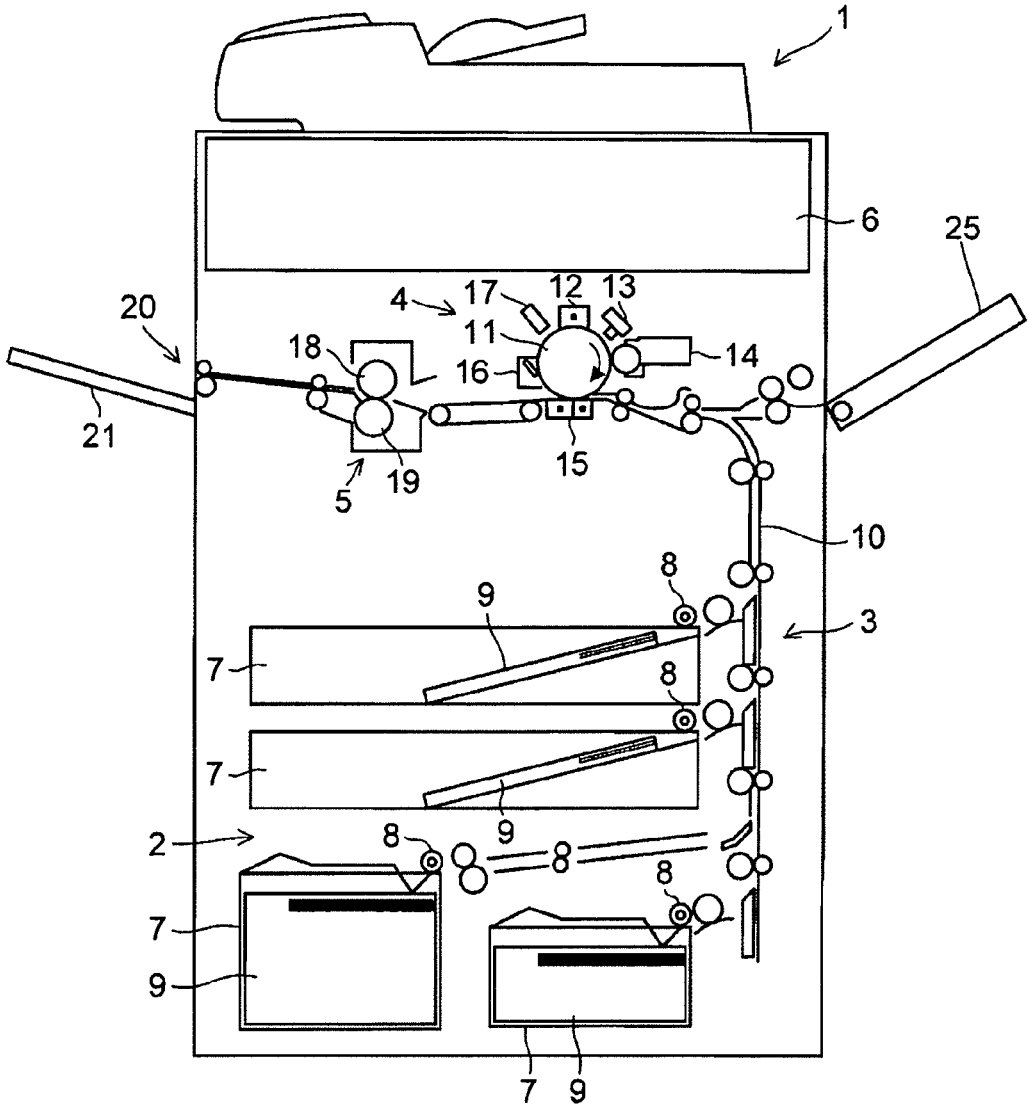
FIG. 1 is a diagram showing an outline of the structure of an image forming apparatus according to the first embodiment of the present invention.

FIG. 1 is a diagram showing an outline of the structure of an image forming apparatus embodying the present invention. The image forming apparatus 1 includes; a paper feed portion 2 provided in a lower part of the image forming apparatus 1; a paper transport portion 3 provided to a side of the paper feed portion 2; an image forming portion 4 provided above the paper transport portion 3; a manual paper feed tray 25 provided to the right of the image forming portion 4 outside the apparatus; a fixing unit 5 provided closer to a paper ejection side than the image forming portion 4 is; and an image scanning portion 6 provided above the image forming portion 4 and the fixing unit 5.

The paper feed portion 2 is provided with a plurality of paper feed cassettes 7 for storing paper 9. As a paper feed roller 8 rotates, the paper 9 is taken out sheet by sheet from a selected one of the plurality of the paper feed cassettes 7 without fail, to be fed into the paper transport portion 3.

The manual paper feed tray 25 is provided for placing therein a recoding medium such as a sheet of paper of a size different from the sizes of the paper 9 stored in the paper feed cassettes 7, an OHP sheet, or an envelope, and the sheet of paper, the OHP sheet, or the envelope is fed therefrom into the paper transport portion 3.

The paper 9 fed into the paper transport portion 3 is then transported toward the image forming portion 4 via a paper feed path 10. The image forming portion 4, which forms a toner image on the paper 9 by an electrophotographic method, is provided with a photoconductive body 11 that is pivotally supported to be rotatable in a predetermined direction (the direction indicated by an arrow in FIG. 1), and the image forming portion 4 is also provided with a charging unit 12, an exposure unit 13, a developing unit 14, a transfer unit 15, a cleaning unit 16, and a charge eliminating unit 17, which are arranged around the photoconductive body 11 in this order along the rotation direction of the photoconductive body 11.

The charging unit 12 is provided with a charging wire to which a high voltage is applied. When a surface of the photoconductive body 11 is electrified to a predetermined electric potential by corona discharge generated at the charging wire, the surface of the photoconductive body 11 is uniformly charged. Then, the exposure unit 13 irradiates the photoconductive body 11 with laser light based on image data of an original document scanned by the image scanning portion 6. The electric potential of the surface of the photoconductive body 11 is selectively attenuated by the irradiation of laser light, and thereby an electrostatic latent image is formed on the surface of the photoconductive body 11. Then, the developing unit 14 develops the electrostatic latent image formed on the surface of the photoconductive body 11, and thereby a toner image is formed on the photoconductive body 11. The toner image is transferred by the transfer unit 15 onto the paper 9 which is fed between the photoconductive body 11 and the transfer unit 15.

The paper 9 having the toner image transferred thereon is then transported toward the fixing unit 5 disposed on a downstream side of the image forming portion 4 in a paper transport direction. At the fixing unit 5, a heat roller 18 and a pressure roller 19 apply heat and pressure to the paper 9 to fix the toner image on the paper 9. Then, the paper 9 having the toner image fixed thereon is ejected into an ejection tray 21 by an ejection roller pair 20.

After the transfer performed by the transfer unit 15, toner remaining on the surface of the photoconductive body 11 is removed by the cleaning unit 16, and residual electric charge remaining on the surface of the photoconductive body 11 is removed by the charge removing unit 17. Then, the photoconductive body 11 is charged again by the charging unit 12, and subsequently another round of the same image forming process is carried out.

Figure 2:
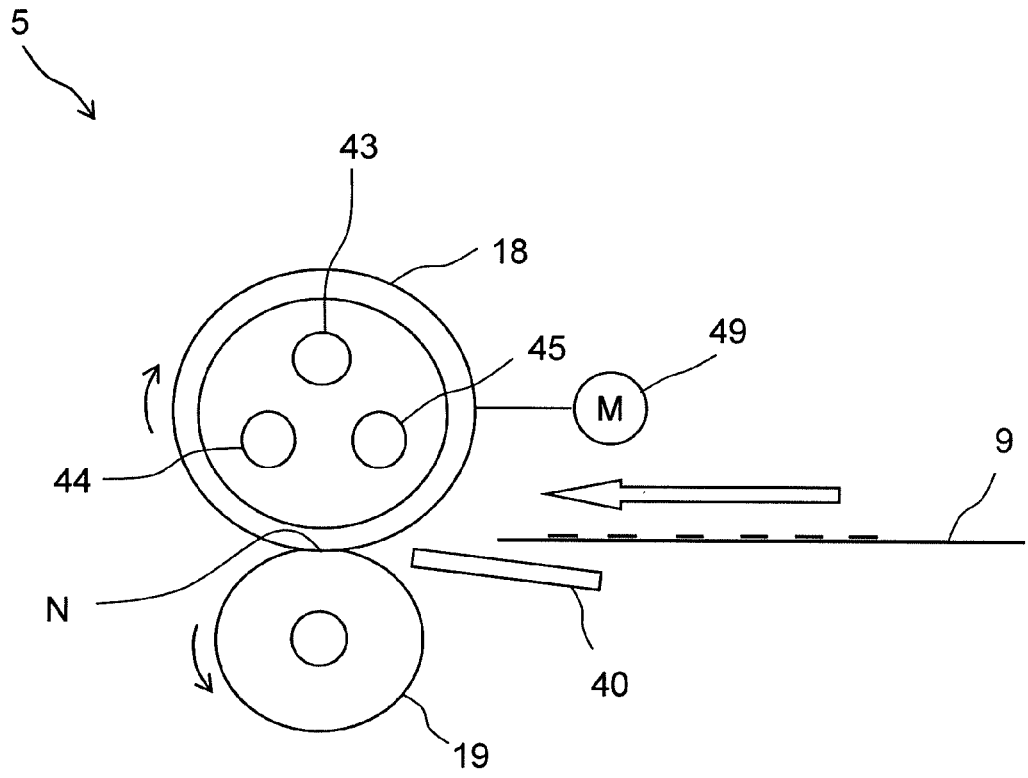
FIG. 2 is a diagram showing an outline of the structure of a fixing unit used in the image forming apparatus according to the first embodiment of the present invention.

The fixing unit 5 will be described in detail based on FIG. 2. FIG. 2 is a diagram showing an outline of the structure of the fixing unit 5 used in the just-described image forming apparatus 1.

The fixing unit 5 employs a roller fixing method, and is provided with the heat roller 18, the pressure roller 19, a plurality of heaters 43 to 45 serving as a heat source, and a drive source 49 having a motor, a speed-reduction gear, and the like.

The heat roller 18 has a cylindrical metal core formed of a metal excellent in thermal conductivity, such as aluminum or iron, and the metal core is coated with a fluororesin coating or a fluororesin tube. Inside the metal core of the heat roller 18, there are provided three heaters 43 to 45, which are, for example, halogen lamps.

The plurality of heaters 43 to 45 are arranged in positions that are equally spaced in the circumferential direction of the heat roller 18, and that are also substantially a same distance away from the surface of the heat roller 18. Furthermore, the plurality of heaters 43 to 45 have different heat distributions in the axial direction of the heat roller 18, for example, in the following manner. In the first heater 43, a smaller amount of heat is distributed to one end portion in the axial direction than to the other portions; in the second heater 44, a larger amount of heat is distributed to one end portion in the axial direction than to the other portions; and in the third heater 45, a larger amount of heat is distributed to the middle portion than to the other portions. The heaters 43 to 45 are arranged in positions determined with respect to a nip portion N. Incidentally, the plurality of heaters may include two heaters, instead of three, having different heat distribution characteristics.

The pressure roller 19 has a cylindrical substrate formed of a material such as a synthetic resin, a metal, or the like, and an elastic layer of silicone rubber or the like formed on the cylindrical substrate, and the surface of the elastic layer is coated with a resin having high releasability such as a fluororesin. The nip portion N is formed where the pressure roller 19 is in contact with the heat roller 18. Where the pressure roller 19 is in contact with the heat roller 18, the elastic layer is elastically deformed, and the nip portion N receives a pressure, which results from the elastic deformation, as a nip pressure.

The drive source 49 is connected via a gear to the heat roller 18, and a drive force is transmitted from the motor to the heat roller 18 through the gear. When the motor is driven to rotate, the heat roller 18 rotates in the direction indicated by an arrow in FIG. 2. The rotation of the heat roller 18 makes the pressure roller 19 pressed against the heat roller 18 rotate following the rotation of the heat roller 18 in the direction indicated by an arrow in FIG. 2, and thus, the heat roller 18 and the pressure roller 19 rotate in opposite directions.

The paper 9 is guided by a transport guide 40, and transported to be nipped in the nip portion N, where heat and pressure is applied to the paper 9 by the heat roller 18 and the pressure roller 19. Thus, toner in a powder state on the paper 9 is fixed by heating. Furthermore, along with the rotations of the heat roller 18 and the pressure roller 19, the paper 9, on which a toner image is fixed, is separated from the heat roller 18 to be transported leftward in FIG. 2.

Figure 3:
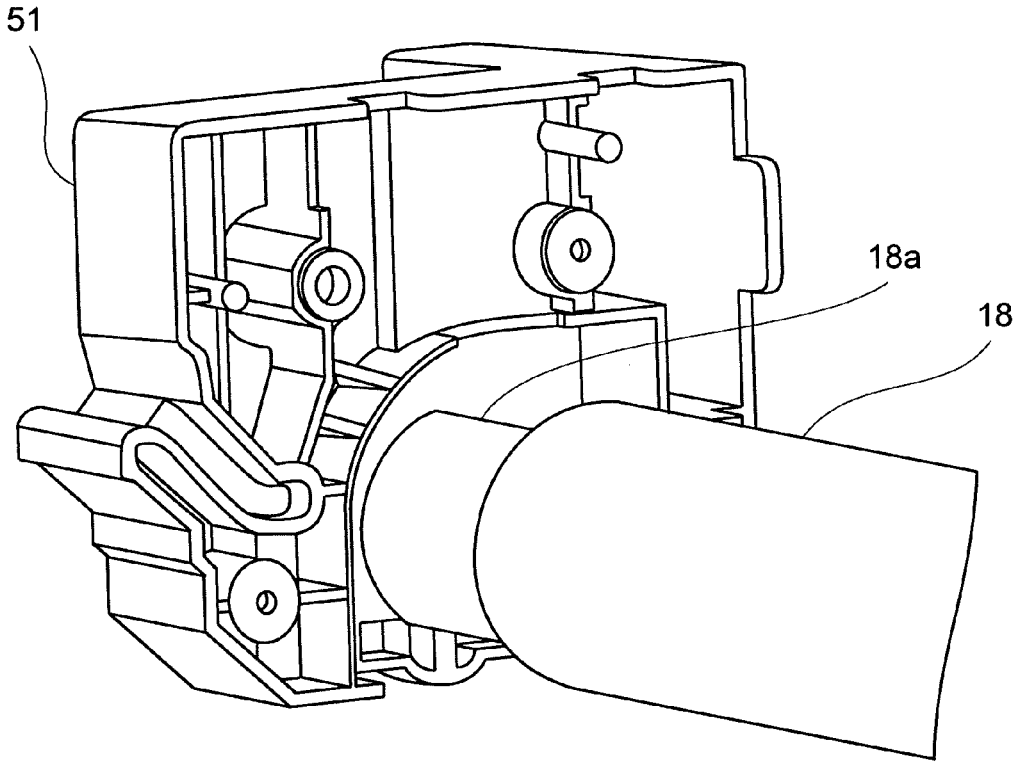
FIG. 3 is a perspective view showing a part of a heat roller of a fixing unit according to the first embodiment of the present invention.

Next, a description will be given of how the heat roller and the heaters are fitted to a unit casing, with reference to FIGS. 3 and 4. FIG. 3 is a perspective view showing a part of the heat roller held in the casing, and FIG. 4 is a perspective view of a principal part showing a state before the heaters are fitted in the casing.

As shown in FIG. 3, the heat roller 18 has a fitting shaft 18*a* provided at one-end side thereof in the axial direction thereof. The fitting shaft 18*a* is rotatably held by a shaft bearing provided in an upper casing 51. Likewise, the other-end side of the heat roller 18 is also rotatably held by the upper casing 51.

Figure 4:
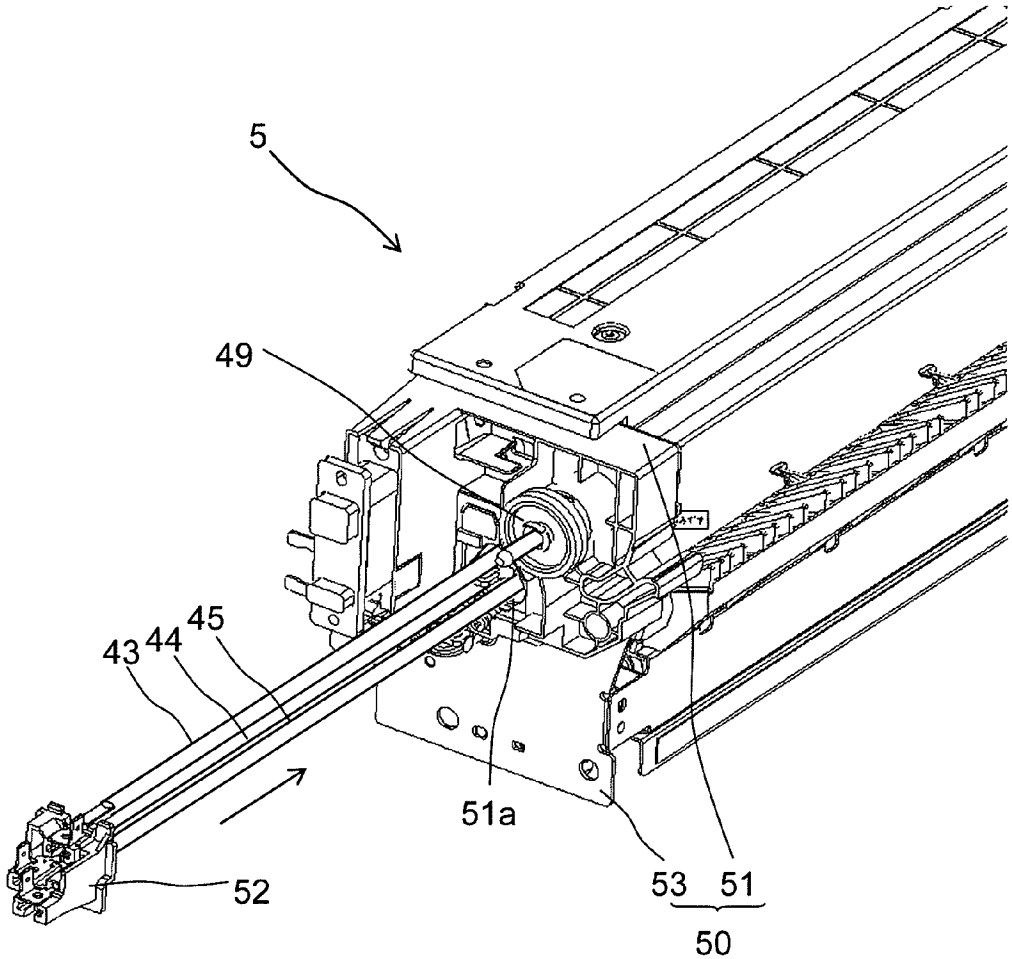
FIG. 4 is a perspective view showing a principal part of a fixing unit according to the first embodiment of the present invention in a state before heaters are fitted.

As shown in FIG. 4, the just-mentioned upper casing 51 and a lower casing 53 are each a part of a casing 50 of the fixing unit. The upper casing 51 is formed of a resin, and pivotally supports the gear of the drive source 49 that makes the heat roller 18 (see FIG. 3) rotate, as well as the heat roller 18. The lower casing 53 is provided below the upper casing 51 to rotatably hold the pressure roller 19 (not shown in the figure).

A holding member 52 is formed of a resin that is both thermally resistive and electrically insulating, and is detachably held by the upper case 51. One-end sides of the first to third heaters 43 to 45 in the axial directions thereof are fitted to the holding member 52. The other-end sides of the first to third heaters 43 to 45 are, although not shown in the figure, each provided with a lead wire to be connected to a power supply or the like.

To fit the first to third heaters 43 to 45 in the upper casing 51, the first to third heaters 43 to 45 are first fitted to the holding member 52, and then the first to third heaters 43 to 45 are inserted into the heat roller 18 (see FIG. 3) through an opening portion 51*a* formed in the upper casing 51, from the other-end sides of the first to third heaters 42 to 45 that are opposite to the one-end sides of the first to third heaters 43 to 45 fitted to the holding member 52. After the first to third heaters 43 to 45 are inserted in the direction indicated by the arrow in FIG. 4, the holding member 52 is fixed to the upper casing 51 with an unillustrated screw. Next, the other-end sides of the first to third heaters 43 to 45 are fitted to an unillustrated metal plate, and the lead wires are each connected to a power supply or the like.

Figure 5:
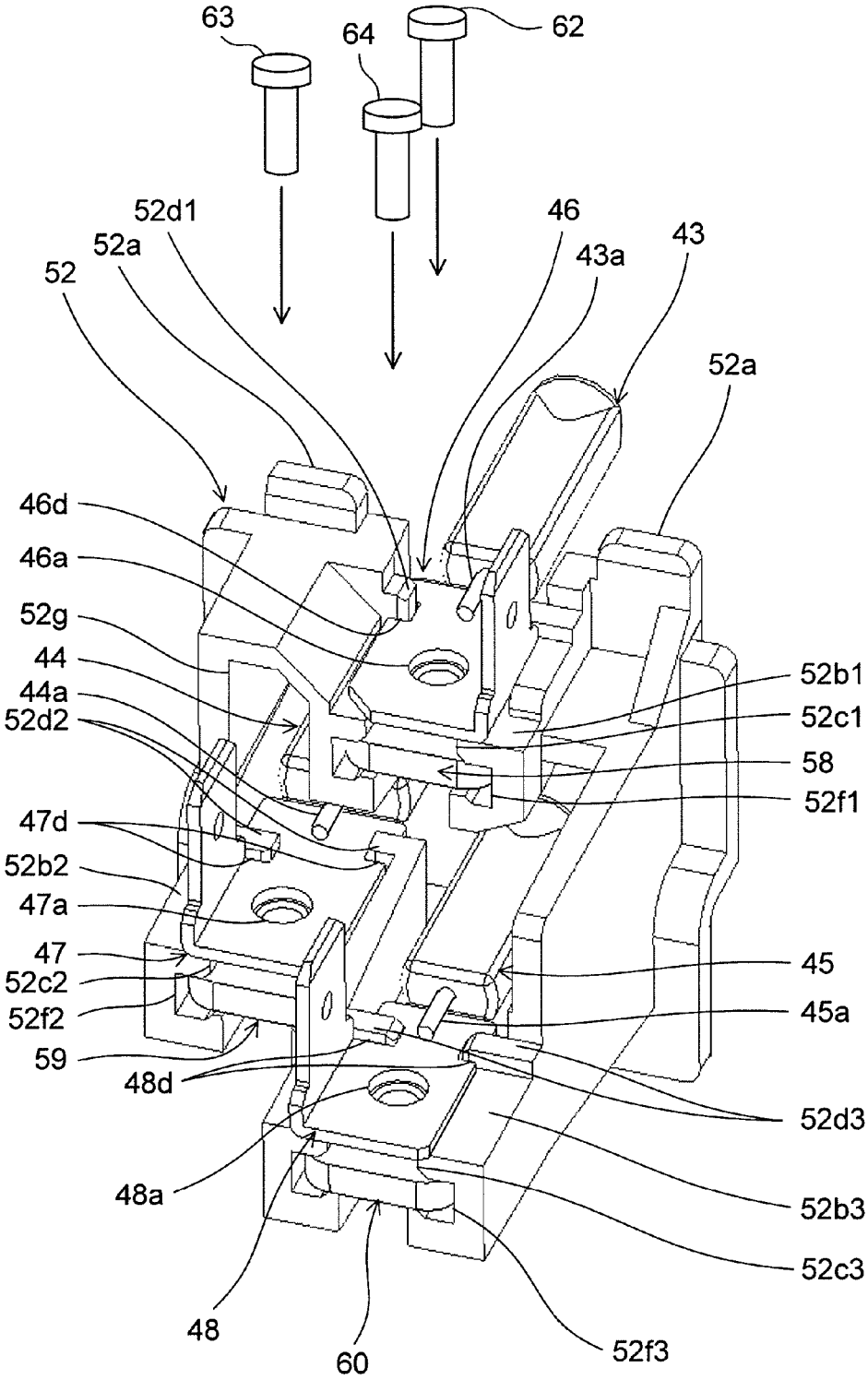
FIG. 5 is a perspective view showing a holding member of a fixing unit according to the first embodiment of the present invention to which heaters are fitted.

Next, a detailed description will be given of how the first to third heaters 43 to 45 are fitted to the holding member 52, with reference to FIG. 5. FIG. 5 is a perspective view showing the holding member 52 to which the first to third heaters 43 to 45 are fitted. Incidentally, FIG. 5 shows part of the first to third heaters 43 to 45 arranged to extend right upward before they are fitted in the heat roller.

For fitting the first to third heaters 43 to 45 to the holding member 52, screws 62 to 64 and nuts 58 to 60 are provided in addition to the first to third heaters 43 to 45 and the holding member 52.

The first to third heaters 43 to 45 have: glass tubes in each of which a tungsten filament is provided and a halogen gas is sealed; and lead wires 43*a* to 45*a* protruding from ends of the glass tubes. The heaters 43 to 45 have different lengths in the axial direction; that is, the first heater 43 is the shortest, the second heater is longer than the first heater 43, and the third heater 45 is longer than the second heater 44. The lead wires 43*a* to 45*a* of the first to third heaters 43 to 45, respectively, are connected to first to third terminal portions 46 to 48 by pressure bonding or soldering.

The first terminal portion 46 is formed of an L-shaped metal plate. A standing portion of the first terminal portion 46 can be electrically connected to a lead wire (unillustrated in the figure), and a transverse portion of the first terminal portion 46 has a hole portion 46*a* into which the screw 62 is inserted and a pair of cut portions 46*d* used for positioning the first terminal portion 46 in the holding member 52. The cut portions 46*d* are formed one on each of opposing side edges of the transverse portion.

The holding member 52 has a flat portion 52*b*1 that faces the transverse portion of the first terminal portion 46. In the flat portion 52*b*1, there are formed an elongate hole portion 52*c*1 through which the screw 62 can be inserted from above and a pair of protruding portions 52*d*1 with which the cut portions 46*d* are engaged. Furthermore, below the flat portion 52*b*1 of the holding member 52, a rectangle hollow portion 52*f*1 is formed. The hollow portion 52*f*1 accommodates the nut 58, which is formed in a shape of a rectangle plate slightly smaller than the opening of the hollow portion 52*f*1. In the nut 58, there is formed a screw hole into which the screw 62 is screwed. The flat portion 52*b*1, the elongate hole portion 52*c*1, and the pair of protruding portions 52*d*1 form a fitting portion.

To fit the first heater 43 to the holding member 52, the cut portions 46*d* of the first terminal portion 46 that is fixed to the first heater 43 by pressure bonding or soldering is engaged with the pair of protruding portions 52*d*1 of the holding member 52 from above in FIG. 5 such that the first terminal portion 46 is in contact with the upper surface of the flat portion 52*b*1 of the holding member 52. In this state, the screw 62 is inserted into the hole portion 46*a* of the first terminal portion 46 and the elongate hole portion 52*c*1 of the holding member 52 in the direction indicated by an arrow in FIG. 5. The thus inserted screw 62 is screwed into the screw hole of the nut 58 accommodated in the hollow portion 52*f*1. Thereby, the first terminal portion 46 is fitted to the holding member 52.

Next, a detailed description will be given of how the second heater 44 is fitted to the holding member 52. The second heater 44 is fitted to a position that is below and to the left of the first heater 43 and that is also more to the front than the first heater 43 in FIG. 5. That is, the second terminal portion 47 of the second heater 44 is fitted to be farther away from a roller-facing portion 52*a* of the holding member 52 than the first terminal portion 46. Incidentally, the roller-facing portion 52*a* is a portion of the holding member 52 with which an end face of the heat roller 18 can be brought into contact.

The second terminal portion 47 is formed of an L-shaped metal plate. A standing portion of the second terminal portion 47 can be electrically connected to a lead wire (unillustrated in the figure), and a transverse portion of the second terminal portion 47 has a hole portion 47*a* into which the screw 63 is inserted and a pair of cut portions 47*d* used for positioning the second terminal portion 47 in the holding member 52. The cut portions 47*d* are formed one on each of opposing side edges of the transverse portion.

The holding member 52 has a flat portion 52*b*2 that faces the transverse portion of the second terminal portion 47 and is parallel to the flat portion 52*b*1 for fitting the first terminal portion 46. In the flat portion 52*b*2, there are formed an elongate hole portion 52*c*2 through which the screw 63 can be inserted from above and a pair of protruding portions 52*d*2 with which the cut portions 47*d* are engaged. Furthermore, below the flat portion 52*b*2 of the holding member 52, a rectangle hollow portion 52*f*2 is formed. The hollow portion 52*f*2 accommodates the nut 59, which is formed in a shape of a rectangle plate slightly smaller than the opening of the hollow portion 52*f*2. In the nut 59, there is formed a screw hole into which the screw 63 is screwed. The flat portion 52*b*2, the elongate hole portion 52*c*2, and the pair of protruding portions 52*d*2 form a fitting portion.

Furthermore, the holding member 52 has an opening portion 52*g* through which the second and third heaters 44 and 45 are inserted from the roller-facing portion 52*a* side. The opening portion 52*g* is an opening formed below the flat portion 52*b*2 to extend from the side where the roller-facing portion 52*a* is located to the side where the flat portion 52*b*2 and a later-described flat portion 52*b*3 are located.

To fit the second heater 44 to the holding member 52, the second heater 44 to which the second terminal portion 47 is fixed by pressure bonding or soldering is inserted into the opening portion 52*g* from the roller-facing portion 52*a* side toward the front side in FIG. 5. Then, the cut portions 47*d* of the second terminal portion 47 are engaged with the protruding portions 52*d*2 from above in FIG. 5 such that the second terminal portion 47 is in contact with the upper surface of the flat portion 52*b*2 of the holding member 52. In this state, the screw 63 is inserted into the hole portion 47*a* of the second terminal portion 47 and the elongate hole portion 52*c*2 of the holding member 52 in the direction indicated by an arrow in FIG. 5 in the same manner as the screw 62 for fitting the first heater 43. The thus inserted screw 63 is screwed into the screw hole of the nut 59 accommodated in the hollow portion 52*f*2. Thereby, the second terminal portion 47 is fitted to the holding member 52.

Next, a description will be given of how the third heater 45 is fitted to the holding member 52. The third heater 45 is fitted to a position that is below and to the right of the first heater 43 and that is also more to the front than the second heater 44 in FIG. 5. That is, the third terminal portion 48 of the third heater 45 is fitted to be farther away from a roller-facing portion 52*a* of the holding member 52 than the second terminal portion 47. In the case in which the first to third heaters 43 to 45 have different lengths in the axial direction, by fitting the first to third heaters 43 to 45 in different positions in the holding member 52 corresponding to their lengths in the axial direction in this way, positions of connection between the power supply or the like and each of the lead wires provided on the other-end sides of the first to third heaters 43 to 45 can be equal to one another in the axial direction of the heat roller 18. Conversely, if the positions of connection between the power supply or the like and each of the lead wires provided on the other-end sides of the first to third heaters 43 to 45 are not to one another in the axial direction of the heat roller 18, it means that the first to third heaters 43 to 45 are erroneously fitted to the holding member 52.

The third terminal portion 48 is formed of an L-shaped metal plate. A standing portion of the third terminal portion 48 can be electrically connected to a lead wire (unillustrated in the figure), and a transverse portion of the second terminal portion 47 has a hole portion 48*a* into which the screw 64 is inserted and a pair of cut portions 48*d* used for positioning the second terminal portion 48 in the holding member 52. The cut portions 48*d* are formed one on each of opposing side edges of the transverse portion. The left-hand sides of the second and third terminal portions 47 and 48 in FIG. 5 are each bent up to form an L-shape, and the right-hand side of the first terminal portion 48 in FIG. 5 is bent up to form an L-shape, so as to correspond to the arrangement of connection members such as lead wires, but instead, the first to third terminal portion 46 to 48 may be formed in a same shape by bending up the same sides thereof, to thereby reduce the production cost.

The holding member 52 has a flat portion 52*b*3 that faces the transverse portion of the third terminal portion 48 and is parallel to the flat portion 52*b*1 for fitting the first terminal portion 46. In the flat portion 52*b*3, there are formed an elongate hole portion 52*c*3 through which the screw 64 can be inserted from above and a pair of protruding portions 52*d*3 with which the cut portions 48*d* are engaged. Furthermore, below the flat portion 52*b*3 of the holding member 52, a hollow portion 520 is formed. The hollow portion 520 accommodates the nut 60, which is formed in a shape of a rectangle plate slightly smaller than the opening of the hollow portion 5213. In the nut 60, there is formed a screw hole into which the screw 64 is screwed. The flat portion 52*b*3, the elongate hole portion 52*c*3, and the pair of protruding portions 52*d*3 form a fitting portion. Incidentally, the nuts 58 to 60 are formed in a same shape. Forming the nuts 58 to 60 in the same shape leads to lower production cost. The screws 62 to 64 are also formed in a same shape. Forming the screws 62 to 64 in the same shape leads to lower production cost.

To fit the third heater 45 to the holding member 52, the third heater 45 to which the third terminal portion 48 is fitted by pressure bonding or soldering is inserted into the opening portion 52*g* from the roller-facing portion 52*a* side toward the front side in FIG. 5. Then, the cut portions 48*d* of the third terminal portion 48 are engaged with the protruding portions 52*d*3 from the upper side in FIG. 5 such that the third terminal portion 48 is in contact with the upper surface of the flat portion 52*b*3 of the holding member 52. In this state, the screw 64 is inserted into the hole portion 48*a* of the third terminal portion 48 and the elongate hole portion 52*c*3 of the holding member 52 in the direction indicated by an arrow in FIG. 5 in the same manner as the screw 62 for fitting the first heater 43. The inserted screw 64 is screwed into the screw hole of the nut 60 accommodated in the hollow portion 52*f*3. Thereby, the third terminal portion 48 is fitted to the holding member 53.

After the first to third heaters 43 to 45 are fitted to the holding member 52 in this way, then, as shown in FIG. 4, the first to third heaters 43 to 45 fitted to the holding member 52 are inserted from the other-end sides thereof into the upper casing 51 through the opening portion 51*a* in a direction indicated by the arrow in FIG. 4, and thereafter, the holding member 52 is fixed to the upper casing 51 with an unillustrated screw. Next, the other-end sides of the first to third heaters 43 to 45 are fitted to an unillustrated metal plate, the lead wires provided at the other ends of the first to third heaters 43 to 45 are electrically connected to the power supply or the like, and then lead wires are soldered to the standing portions of the first to third terminal portions 46 to 48.

According to the above-described first embodiment, the fixing unit 5 is provided with the heat roller 18 having the plurality of heaters 43 to 45 provided therein for applying heat to a toner image formed on the paper 9, the upper case 51 for holding the heat roller 18, the holding member 52 detachably fitted to the upper casing 51, and the plurality of fitting portions that are provided in the holding member 52 and to which the first to third terminal portions 46 to 48 of the plurality of heaters 43 to 45 can be detachably fitted from the same direction.

With this structure, since the first to third terminal portions 46 to 48 of the plurality of heaters 43 to 45 can be fitted to the fitting portions of the holding member 52 from the same direction, the plurality of heaters 43 to 45 can be fitted to the holding member 52 with improved workability. Furthermore, by inserting the plurality of heaters 43 to 45 fitted to the holding member 52 into the heat roller 18 all together, the heaters can be inserted into the heat roller 18 with improved workability. Moreover, the plurality of heaters 43 to 45 can be removed from the heat roller 18 by removing the screw with which the holding member 52 is fitted to the upper casing 51, and then detaching the holding member 52 from the upper casing 51. Thus, the plurality of heaters 43 to 45 are taken out of the heat roller 18 all together, resulting in improved workability in, for example, replacing a broken heater.

In addition, according to the above-described first embodiment, the plurality of fitting portions of the holding member 52 are provided in positions different from one another in the axial direction of heat roller 18.

With this structure, the first to third terminal portions 46 to 48 of the plurality of heaters having different heat distribution characteristics can each be fitted to a set one of the fitting portions of the holding member 52, and this helps prevent the heaters 43 to 45 from being fitted to wrong positions in the holding member 52. Furthermore, inserting the plurality of heaters 43 to 45 into the heat roller 18 after they are fitted to the predetermined positions of the holding member 52 eliminates the trouble of adjusting the positions of the heaters having different heat distribution characteristics inside the heat roller 18, and this leads to improved workability.

According to the above-described first embodiment, the plurality of heaters 43 to 45 are different in length in the axial direction of the heat roller 18, and the plurality of fitting portions of the holding member 52 are provided in positions different from one another in the axial direction of the heat roller 18. When the first to third terminals of the plurality of heaters 43 to 45 are fitted to the fitting portions, the positions of the ends of the plurality of heaters 43 to 45 at the side that is, in the axial direction of the heat roller 18, opposite from the side where the fitting portions are located, are equal to one another in the axial direction of the heat roller 18.

With this structure, if the positions of the ends of the plurality of heaters 43 to 45 at the side that is, in the axial direction of the heat roller 18, opposite from the side where the fitting portions are located, are not equal to one another in the axial direction of the heat roller 18, it means that the plurality of heaters 43 to 45 are not fitted to the predetermined positions in the holding member 52. Thus, erroneous fitting of the heaters can be easily found.

According to the above-described first embodiment, the plurality of fitting portions of the holding member 52 have the flat portions 52*b* 1 to 52*b*3 with which the first to third terminal portions 46 to 48 are brought into contact, respectively, to face the same direction.

With this structure, since the plurality of heaters 43 to 45 are fitted to the holding member 52 with the first to third terminal portions 46 to 48 in contact with the flat portions 52*b*1 to 52*b*3, respectively, that face the same direction, the workability in fitting the plurality of heaters 43 to 45 to the holding member 52 can be improved.

According to the above-described first embodiment, the plurality of fitting portions have the protruding portions (positioning portions) 52*d*1 to 52*d*3 that determine the fitting positions, in the holding member 52, of the first to third terminal portions 46 to 48, respectively.

With this structure, the trouble of positioning can be eliminated by fitting the first to third terminal portions 46 to 48 to the holding member 52 such that the cut portions 46*d* to 48*d* of the first to third terminal portions are engaged with the protruding portions 52*d*1 to 52*d*3 of the holding member 52.

According to the above-described first embodiment, the first to third terminal portions 46 to 48 are fitted to the plurality of fitting portions of the holding member 52, with the screws 62 to 64 and the nuts 58 to 60 into which the screws 62 to 64, respectively, are screwed.

With this structure, the first to third terminal portions 46 to 48 can be maintained securely fixed to the holding member 52.

According to the above-described first embodiment, the nuts 58 to 60 are each formed in a plate shape, and the plurality of fitting portions have the hollow portions 52*f*1 to 52*f*3 that accommodate the nuts 58 to 60.

With this structure, when the screws 62 to 64 are screwed into the nuts 58 to 60 accommodated in the hollow portions 52*f*1 to 52*f*3 to fit the first to third terminal portions 46 to 48 to the fitting portions, the nuts 58 to 60 do not rotate in the hollow portions 52*f*1 to 52*f*3. This eliminates the trouble of holding the nuts 58 to 60 while the screws are being screwed into them, and thus the first to third terminal portions 46 to 48 of the heaters 43 to 45 can be fitted to the holding member 52 with improved workability.

According to the above-described first embodiment, the pressure roller 19 is provided to be pressed against the heat roller 18, and a toner image formed on the paper 9 is fixed by being heated at the nip portion N at which the heat roller 18 and the pressure roller 19 are pressed against each other.

With this structure, the toner image on the paper 9 can be fixed by heating at the nip portion N. Furthermore, since the first to third terminal portions 46 to 48 of the plurality of heaters 43 to 45 can be detachably fitted to the holding member 52 from a same direction, the plurality of heaters 43 to 45 can be fitted to the holding member 52 with improved workability. Moreover, by inserting the plurality of heaters 43 to 45 into the heat roller 18 all together after they are fitted to the holding member 52, the heaters can be inserted into the heat roller 18 with improved workability.

In the above-described first embodiment, the first to third heaters 43 to 45 are provided with the first to third terminal portions 46 to 48 each formed of an L-shaped metal plate, but this is not meant to limit the present invention; instead, the first to third terminal portions may each be formed as a flat terminal that is fitted by pressure bonding or soldering to a lead wire protruding from the end of the glass tube of a corresponding one of the heaters. In this case, L-shaped connection terminal members are fitted one to each of the flat portions of the holding member. The flat terminal of each of the heaters is placed on and in contact with a corresponding one of the connection terminal members. And, each of the flat terminals is fitted to the holding member, with a screw, with the corresponding one of the connection terminal members therebetween. Thereafter, a lead wire is soldered to the standing portion of each of the L-shaped connection terminal members.

Second Embodiment

Figure 6:
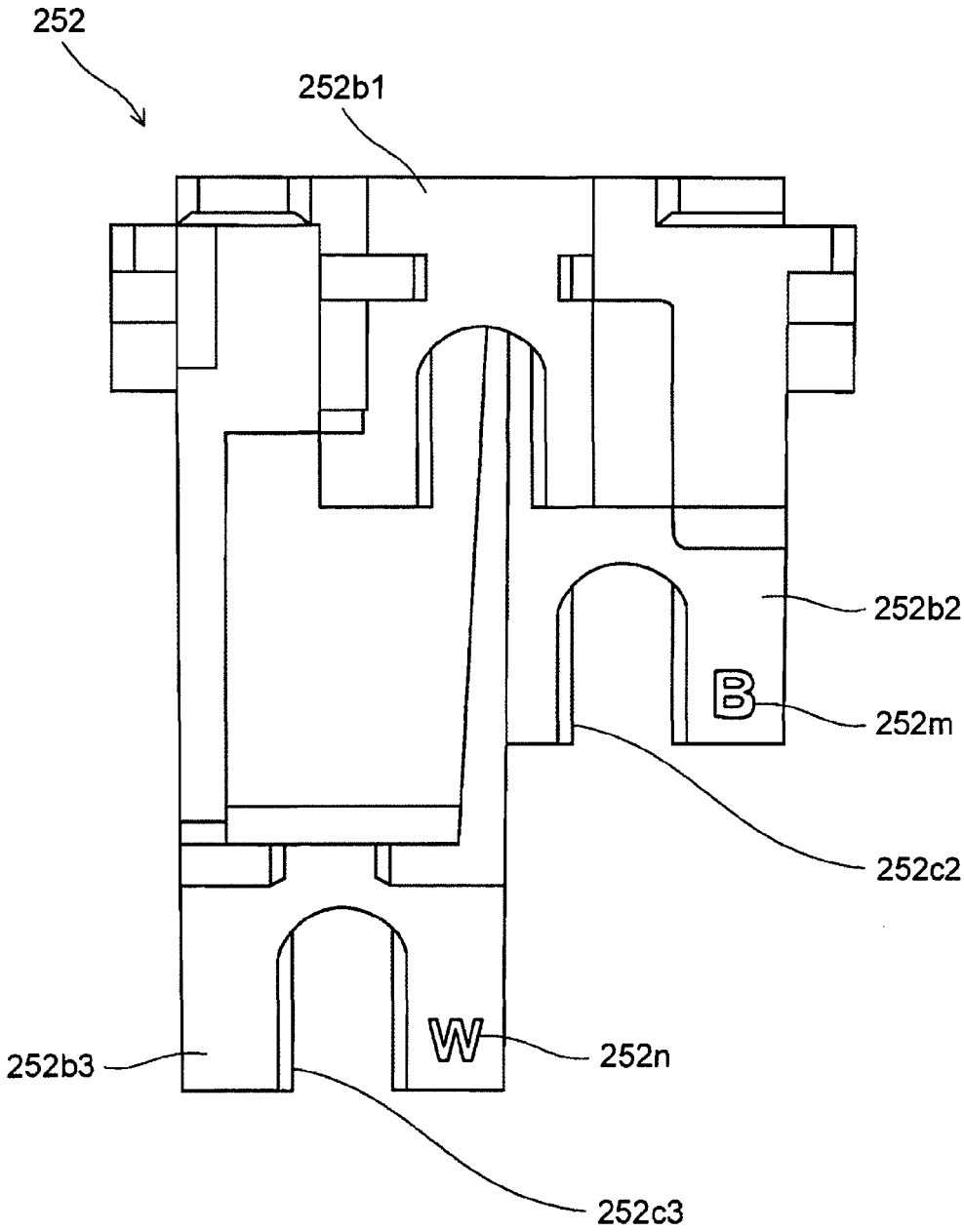
FIG. 6 is a side view showing a holding member provided with a mark portion used in a fixing unit according to the second embodiment of the present invention.

FIG. 6 is a side view seen from a screw fitting direction, showing a holding member provided with a mark portion used in a fixing unit according to the second embodiment of the present invention. The description below will be focused mainly on the holding member which distinguishes the second embodiment from the first embodiment, and a description of portions that are similar to those in the first embodiment will be omitted.

A holding member 252 is used in a roller-fixing type fixing unit as in the first embodiment, and it is different from the holding member 52 of the first embodiment in the following manner.

The holding member 252 has a flat portion 252*b*1 to which a first terminal portion can be fitted, a flat portion 252*b*2 to which a second terminal portion can be fitted, and a flat portion 252*b*3 to which a third terminal portion can be fitted, as in the first embodiment, but, in contrast to the first embodiment, the flat portion 252*b*3 is positioned to the left of the flat portion 252*b*2.

Furthermore, the holding member 252 has a mark portion 252*m* in the vicinity of an elongate hole portion 252*c*2 formed in the flat portion 252*b*2. The mark portion 252*m* is formed as a mark "B" when the holding member 252 is formed by resin molding. The mark "B" as an abbreviation of the word "black" corresponds to the color of the insulation tube with which the lead wire of the second heater is coated. In fitting the terminal portion of the second heater to the flat portion 252*b*2, the fitting portion to which the flat portion 252*b*2 should be fitted is recognized by using the mark portion 252*m*.

The holding member 252 also has a mark portion 252*n* in the vicinity of an elongate hole portion 252*c*3 formed in the flat portion 252*b*3. The mark portion 252*n* is formed as a mark "W" when the holding member 252 is formed by resin molding. The mark "W" as an abbreviation of the word "white" corresponds to the color of the insulation tube with which the lead wire of the third heater is coated. In fitting the terminal portion of the third heater to the flat portion 252*b*3, the fitting portion to which the flat portion 252*b*3 should be fitted is recognized by using the mark portion 252*n*.

The mark portions 252*m* and 252*n* may be achieved by adhering seals on which "B" and "W" are printed, respectively, to predetermined positions in the holding member 252. Furthermore, instead of in the vicinities of the elongate hole portions 252*c*2 and 252*c*3, the mark portions 252*m* and 252*n* may be arranged in the vicinities of the flat portions 252*b*2 and 252*b*3, respectively, such as rear surface sides of the flat portions 252*b*2 and 252*b*3, respectively. Moreover, a mark indicating the color of the insulation tube covering the lead wire of the first heater may be provided in the vicinity of the flat portion 252*b*1.

According to the above-described second embodiment, the mark portions 252*m* and 252*n* by which to recognize the terminal portions of the heaters to be fitted to the holding member 252 are provided in the vicinities of the corresponding fitting portions.

With this structure, when the terminal portions of the heaters having different heat distribution characteristics are fitted to the holding member 252, the fitting portions are recognized by using the mark portions 252*m* and 252*n*, and this helps prevent the heaters from being fitted to wrong positions. Furthermore, inserting the plurality of heaters fitted to the predetermined positions of the holding member 252 into the heat roller eliminates the need for the troublesome operation of adjusting the positions of the heaters having different heat distribution characteristics inside the heat roller, and this leads to improved workability.

According to the above-described second embodiment, the mark portions 252*m* and 252*n* are formed as marks corresponding to the colors of the insulation tubes covering the lead wires fitted to the terminal portions.

With this structure, it is possible to prevent the heaters from being fitted in wrong positions by fitting the terminal portions of the heaters to the holding member by matching the colors of the insulation tubes to the marks corresponding to the colors.

Third Embodiment

Figure 7:
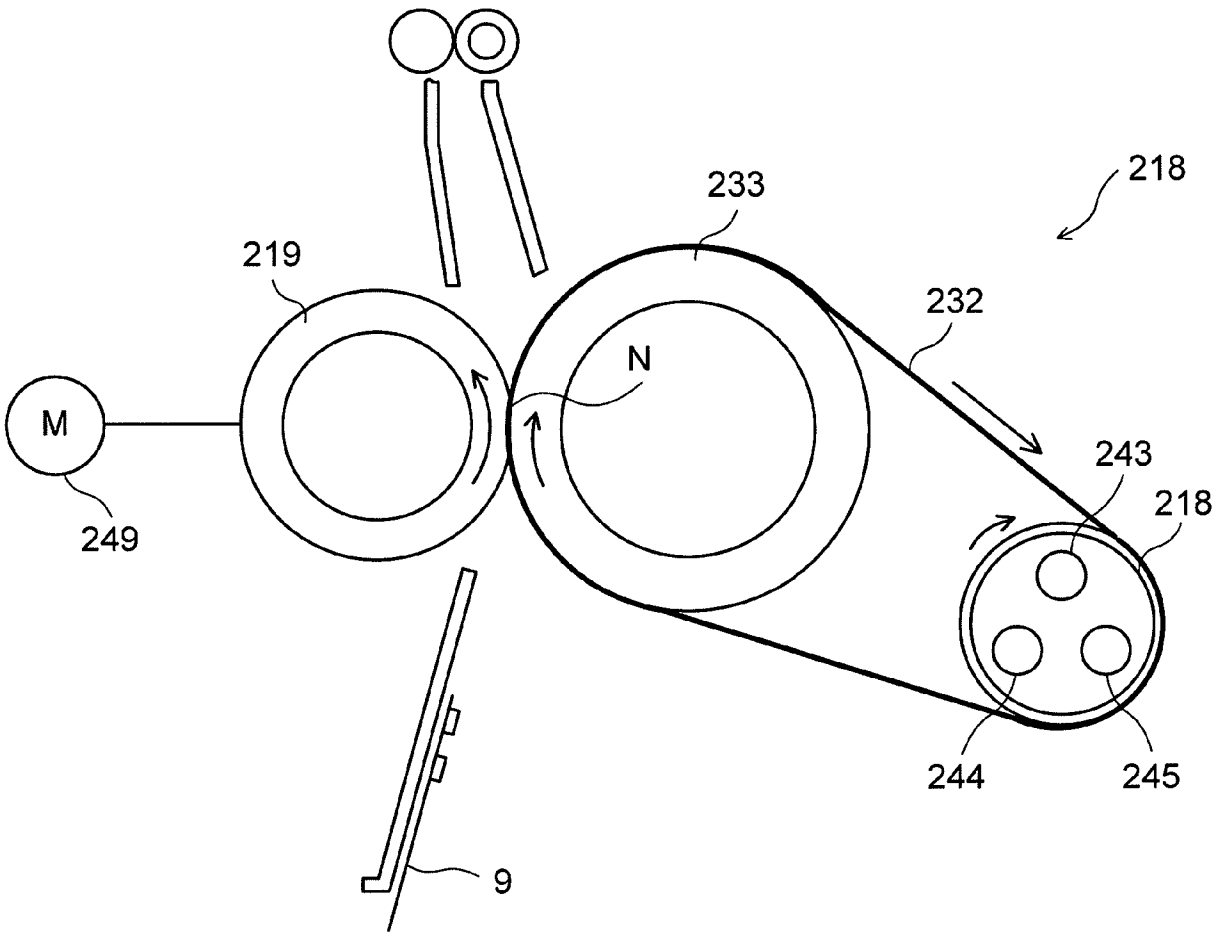
FIG. 7 is a diagram showing an outline of the structure of a fixing unit used in an image forming apparatus according to the third embodiment of the present invention.

FIG. 7 is a diagram showing an outline of the structure of a fixing unit according to the third embodiment of the present invention. As shown in FIG. 7, the present invention is also applicable to a belt-fixing type fixing unit.

The fixing unit is provided with a fixing belt 232, a fixing roller 233, a pressure roller 219, a heat roller 218, a plurality of heaters 243 to 245 serving as a heat source, and a drive source 249 having a motor and a speed-reduction gear.

The heat roller 218 has a cylindrical metal core made of a metal excellent in thermal conductivity, such as aluminum or iron, and the metal core is coated with a fluororesin coating or a fluororesin tube. Inside the metal core of the heat roller 218, there are provided three heaters 243 to 245, which are, for example, halogen lamps.

The plurality of heaters 243 to 245 are arranged in positions that are equally spaced in the circumferential direction of the heat roller 218, and that are also substantially a same distance away from the surface of the heat roller 218. Furthermore, the plurality of heaters 243 to 245 have different heat distributions in the axial direction of the heat roller 218, for example, in the following manner. In the heater 243, a smaller amount heat is distributed to one end portion in the axial direction than to the other portions; in the heater 244, a larger amount of heat is distributed to one end portion in the axial direction than to the other portions; and in the heater 245, a larger amount of heat is distributed to the middle portion than to the other portions. The plurality of heaters 243 to 245 are detachably fitted to a holding member similar to the holding member of the first embodiment.

The fixing belt 232 is an endless belt formed of a thin nickel plate, and its outer surface is coated with an offset preventing agent such as a silicone rubber film.

The fixing roller 233 is formed of a cylindrical substrate and a sponge rubber layer formed on the cylindrical substrate, and gives elasticity to a nip portion N. The fixing roller 233 is pivotally supported to be rotatable, and the fixing belt 232 is wound around the fixing roller 233 and the heat roller 218. Heat from the plurality of heaters 243 to 245 provided in the heat roller 218 is transmitted to the fixing belt 232 via the heat roller 218, whereby the fixing belt 232 is heated.

The pressure roller 219 has a cylindrical substrate formed of a material such as a synthetic resin, a metal, or the like, on which an elastic layer is formed of silicone rubber or the like, and a surface of the elastic layer is covered with a resin having high releasability such as a fluororesin. The nip portion N is formed between the pressure roller 219 and the fixing belt 232 by the pressure roller 219 being pressed toward the center of the fixing roller 233 with the fixing belt 232 therebetween.

The drive source 249 is connected via a gear to the pressure roller 219, and a drive force is transmitted from the motor to the pressure roller 219 through the gear. When the motor is driven to rotate, the pressure roller 219 rotates in the direction indicated by an arrow in FIG. 7. The rotation of the pressure roller 219 causes the fixing roller 233 and the fixing belt 232, which are pressed against the pressure roller 219, to rotate in the direction indicated by arrows in FIG. 7 at a same speed, and further, the heat roller 218 rotates following the rotation of the fixing belt 232.

The fixing belt 232 and the pressure roller 219 apply heat and pressure to the paper 9 transported to the nip portion N, and thus the toner in a powder state on the paper 9 is fixed by heating. Furthermore, as the fixing belt 232 and the pressure roller 219 rotate, the paper 9, on which the toner image is fixed, is separated from the heat roller 218 to be transported upward in FIG. 7.

According to the above-described third embodiment, the fixing belt 232 formed as an endless belt is wound around the heat roller 218 and the fixing roller 233, the pressure roller 219 is pressed against the fixing roller 233 with the fixing belt 232 therebetween, and a toner image on the paper 9 can be fixed by heating at the nip portion N where the fixing belt 232 and the pressure roller 219 are pressed against each other. Furthermore, the provision of the holding member to which the first to third terminal portions of the plurality of heaters can be detachably fitted from the same direction helps improve the workability in fitting the plurality of heaters to the holding member.

The present invention is applicable to a fixing unit for use in image forming apparatuses that employ an electro-photographic method such as copiers, printers, facsimile machines, and multifunction peripherals having these functions, and the present invention is particularly applicable to a fixing unit having a plurality of heaters provided in a heat roller and an image forming apparatus provided therewith.

What is claimed is:

1. A fixing unit, comprising:

a heat roller having a plurality of heaters provided therein;

a casing holding the heat roller;

a holding member detachably fitted to the casing; and a plurality of fitting portions that are provided in the holding member and to which terminal portions of the plurality of heaters can be detachably fitted from a same direction.

2. The fixing unit according to claim 1, wherein the plurality of fitting portions are arranged in positions different from one another in an axial direction of the heat roller.

3. The fixing unit according to claim 2, wherein lengths of the plurality of heaters in the axial direction of the heat roller are different from one another, and when the terminal portions of the plurality of heaters are fitted to the fitting portions, positions of ends of the plurality of heaters at a side that is, in the axial direction of the heat roller, opposite from a side where the holding member is located are equal to one another in the axial direction of the heat roller.

4. The fixing unit according to claim 1, wherein a mark portion is provided in a vicinity of the fitting portions for recognition of which of the terminal portions is to be fitted to which of the fitting portions.

5. The fixing unit according to claim 4, wherein, as the mark portion, a mark is formed corresponding to a color of an insulation tube covering a lead wire among lead wires fitted to the terminal portions.

6. The fixing unit according to claim 1, wherein the plurality of fitting portions have flat portions with which the plurality of terminal portions are brought into contact to face a same direction.

7. The fixing unit according to claim 6, wherein the plurality of fitting portions have positioning portions determining fitting positions in the holding member to which the plurality of terminal portions are fitted.

8. The fixing unit according to claim 6, wherein the terminal portions and the flat portions are fitted together with screws and nuts into which the screws are screwed.

9. The fixing unit according to claim 8, wherein the nuts are plate-shaped, and the plurality of fitting portions have hollow portions that accommodate the nuts.

10. The fixing unit according to claim 1, wherein a pressure roller is provided to be pressed against the heat roller, and, at a nip portion at which the heat roller and the pressure roller are pressed against each other, a toner image formed on paper is fixed by being heated.

11. An image forming apparatus, comprising the fixing unit according to claim 10.

12. The fixing unit according to claim 1, wherein a fixing belt formed as an endless belt is wound around the heat roller and a fixing roller, a pressure roller is provided to be pressed against the fixing roller with the fixing belt therebetween, and a toner image formed on paper is fixed by heating at a nip portion at which the fixing belt and the pressure roller are pressed against each other.

13. An image forming apparatus, comprising the fixing unit according to claim 12.

* * * * *